United States Patent [19]

Pfleiderer

[11] Patent Number: 4,675,835

[45] Date of Patent: Jun. 23, 1987

[54] DEVICE FOR COMPENSATING REPRODUCTION ERRORS IN AN ELECTROACOUSTIC TRANSDUCER

[76] Inventor: Peter Pfleiderer, Erhardtstrasse 9, D-8000 Munich 5, Fed. Rep. of Germany

[21] Appl. No.: 675,752

[22] Filed: Nov. 28, 1984

[30] Foreign Application Priority Data

Nov. 28, 1983 [DE] Fed. Rep. of Germany ..... 3343027
May 15, 1984 [DE] Fed. Rep. of Germany ..... 3418047

[51] Int. Cl.[4] ..... H04R 3/00

[52] U.S. Cl. ..... 364/571; 73/647; 381/117; 381/121

[58] Field of Search ..... 364/571-574; 73/1 DV, 646-648; 381/94, 98, 99, 117, 121, 56, 96, 108; 179/107 FD, 170 E; 379/5

[56] References Cited

U.S. PATENT DOCUMENTS 4,340,778 7/1982 Cowans et al. ..... 381/117 X
4,391,124 7/1983 Drost et al. ..... 364/571 X
4,434,648 3/1984 Drost et al. ..... 73/1 DV
4,446,715 5/1984 Bailey ..... 364/571 X
4,555,797 11/1985 Nieuwendijk et al. ..... 381/121 X
4,558,426 12/1985 Solt, Jr. ..... 364/571 X
4,566,120 1/1986 Nieuwendijk et al. ..... 381/117

*Primary Examiner*—Errol A. Krass
*Assistant Examiner*—H. R. Herndon
*Attorney, Agent, or Firm*—Kane, Dalsimer, Kane, Sullivan and Kurucz

[57] ABSTRACT

In order to compensate reproduction errors in electroacoustic transducers (W), for example electrodynamic loud-speakers, microphones and pickup systems, computer circuits are used. In a digital computer circuit, the electrical input signals ($U_1$) are converted into altered output signals ($U_2$) according to the inherent properties of the transducer (W), stored in a memory (PROM), with the aid of a programme, which is likewise stored. When analogue computer circuits are used, the complex inherent response of the converter (W) in respect of the amplitude/frequency response and phase/frequency response is approximated mathematically in a closed, inverse form, and the resulting function is simulated with the aid of integrators (B), summing elements (S), inverters (I) and adjusting members (P).

15 Claims, 22 Drawing Figures

DEVICE FOR COMPENSATING REPRODUCTION ERRORS IN AN ELECTROACOUSTIC TRANSDUCER

Figure 1:
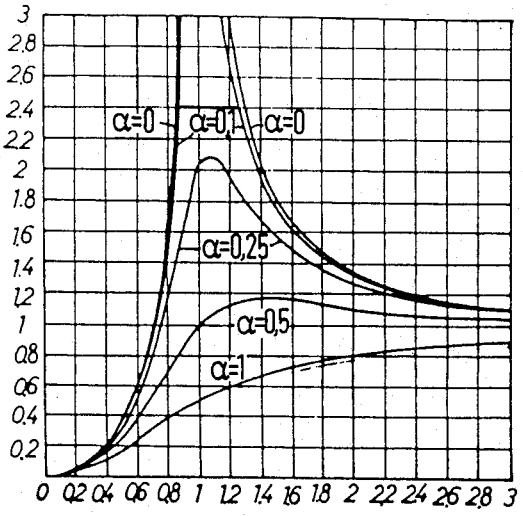

All electroacoustic transducers are mechanical oscillatory systems which are characterised by inherent properties, such as spring rates, mass and damping. Loud-speakers, that is to say, transducers which receive electrical signals and emit acoustic signals, are incited to forced oscillations and damped by the current from an amplifier, for example with the aid of a moving coil. Conversely, microphones are transducers which convert acoustic signals into electrical signals. In the case of electrodynamic microphones this conversion is likewise effected with the aid of a moving coil attached to a diaphragm. Electrodynamic pickup-systems also receive mechanical oscillations and produce electrical signals by the means of oscillations coils. Therefore, there are not fundamental differences between electrodynamic microphones and electrodynamic pickup-systems.

As a result of the constructional and functional principle of coupling the different influences which, in turn, also influence one another, two main serious errors are produced which apply to the same extent to electrodynamic loud-speakers and to microphones.

1. Errors in the amplitude/frequency response

As a result of the inherent properties of the oscillatory system, a characteristic transfer function is produced over a relatively large frequency range. Typical of the so-called amplitude/frequency response is, for example, a non-linear curve having resonance points and the low efficiency at the upper and lower ends of the transfer range. An example of this is a conventional, softly suspended bass loud-speaker mounted in a closed housing and having a diameter of approximately 30 cm, which, at 20 Hz, exhibits only slight acoustic pressure action with excessively low amplitude values, but which, at its resonant frequency in the range of from approximately 40 to 80 Hz, produces an excessive sound volume and excessively high amplitude values and towards the high frequencies again loses effectiveness in sound transmission as a result of excessively low amplitude values. The amplitude to frequency relationship around the resonant frequency with various damping factors $\alpha$ is shown in the form of a graph in FIG. 1. This representation is known prior art and is not explained further here.

2. Errors in the phase/frequency response

As a result of the mass and the damping of the oscillatory system, the building-up process and the decay are clearly distorted in the case of oscillations, of any frequency, that start impulsively. This is caused by the fact that such oscillatory systems, when excited below and above the resonant frequency, have various phase positions with respect to the exciting signal. The phase-angle to frequency relationship around the resonant frequency for various damping factors $\alpha$ is shown in the form of a graph in FIG. 2. This representation is also known prior art and is not explained further here.

During oscillation impulses above and below the resonant frequency, the diaphragm begins to move in the same way but, in the case of impulses near to or below the resonance frequency, especially during the first half oscillation period, reaches only low amplitude values, as a phase displacement takes place during the building-up process. Only when the phase displacement corresponding to the frequency has taken place are the amplitude values corresponding to the exciting signal reached, although they are phase-displaced.

Oscillations that start impulsively, such as the plucking of a guitar string, the striking of a note on a piano or the beating of a drum, exhibit their amplitude maximum at the first stroke and then oscillate at the plucked sound frequency. A loud-speaker system or microphone which is operated in the range of its resonant frequency must initially build up slowly in the case of such impulses until it has the phase position corresponding to the frequency and, depending on its quality, generally does not reach the maximum amplitude until after one or two full oscillation periods. In the case of sudden damping caused by the vibrating guitar or piano string or the skin of the drum being stopped suddenly, the transducer continues to oscillate at least for a period of time determined by the phase displacement. In the subsequent decay, the inherent frequency or resonant frequency of the transducer, which has been damped with a greater or lesser degree of success, becomes noticeable.

Only pure sinusoidal sounds are evaluated by the human ear, from the point of view of volume, according to the amplitude. Sound mixtures, which music always comprises, are evaluated with the aid of their envelope.

While the sound distortions of the transducer system resulting from errors in the amplitude/frequency response, which are perceived as notes that are too loud or too quiet, are seldom noticed during the transmission of music, as it is never possible to be sure that the musician himself did not play the note more loudly or more quietly, errors in the building-up process and the decay are perceived as sound colouration, especially in the case of music that is rich in impulses. The errors in the building-up process and the decay cause a change in the envelope. In addition, phase errors reduce the possibility to locate the sound sources and, therefore, produce an artificial concept of the arrangement of the sound sources. It is especially the errors in the building-up process and the decay and the reduced locateability of the sound sources that make it possible for the listener to tell that the music is not live.

Processes which, using equalisers, enable different volumes to be obtained in the different frequency ranges and hence correct the first error, that is to say the amplitude/frequency response, alone are known. A disadvantage of these processes is that the errors in the phase/frequency response, and hence the building-up process and the decay and, in addition, the locateability, are not corrected but are more likely to be made even worse.

A process is also already known from German Patent Specification No. 31 30 353 which corrects the build-up and decay errors only. A disadvantage of this process is that if there are no impulses in the sound material the error in the amplitude/frequency response is not corrected.

Figure 3:
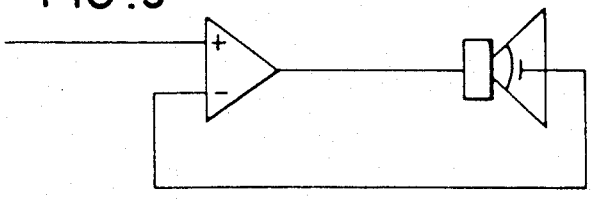

Attempts have also been made to compensate by means of feedback the errors produced as a result of the principle of the dynamic transducer during the conversion from an electrical to an acoustic oscillation. FIG. 3 shows the known arrangement of a loud-speaker having a sensor responsive to the diaphragm movement.

For this purpose, the movement of the diaphragm is scanned capacitively, inductively, piezoelectrically or optically and the electrical signals representing the actual movement of the diaphragm and produced in this manner are compared with the nominal-value signals. The readjustment is effected by means of a differential amplifier. Capacitive movement recorders ascertain, in addition to the total diaphragm movement, also all the partial oscillations of the diaphragm and inductive recorders move in the greatly changing magnetic field which is influenced by the exciter coil, through which current flows. They therefore allow only crude error detection. Piezo recorders are relatively heavy and, as a result of their own weight, exaggerate the original error requiring correction. They cannot be used in the middle and high pitch ranges. Optical recorders having their own control electronics are uneconomically expensive.

Because of the phase-shifting properties of the loud-speaker and the recorder, the automatic control system would start to oscillate in the casee of high loop amplification. In order to prevent this, the loop amplification must be reduced to low values, for example 20, which greatly impairs the effectiveness of the feedback.

Furthermore, readjustment only ever enables the errors in amplitude that occur to be recognised, determined and corrected.

When errors in the phase position occur in the case of impulses, they manifest themselves in the form of, for example, too small an amplitude. Pure amplitude readjustment in the case of a building-up process that is still counter phase, however, requires excessively high correction-current impulses which the amplifier generally cannot supply, as it has already made its output available for the music impulse. Moreover, such readjustments of the diaphragm can only become effective after some delay from the appearance of the error, and hence, especially when the phase position is incorrect, can never prevent the errors altogether.

In the case of large changes in amplitude, as often encountered in modern entertainment and dance music, the large readjustment correction signals can lead to short-term overloading of the final amplifier and hence to high distortion.

Although in practice readjustment can have a compensatory effect on the amplitude errors in the transfer function of the loud-speaker, for example in the case of its resonant frequency acting over several oscillation periods, in the case of the phase-position-dependent correction of the building-up process and the decay where there are sudden changes in amplitude, it has only a slight effect in the critical first half oscillation period. Feedback control systems of the type described cannot, of course, be used for microphones and pickups.

Figure 4:
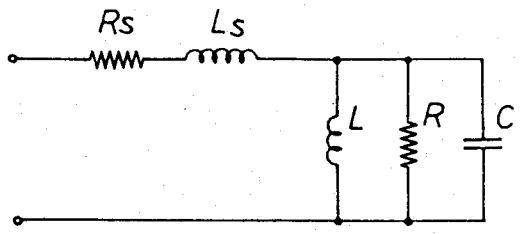

In order to avoid the problems encountered with the sensors on the loud-speaker diaphragm, attempts have also already been made to work with the aid of an electrical simulation of the loud-speaker, in the form of an equivalent circuit, as shown in FIG. 4. The electrical values showing an example of a bass, middle-range and treble loud-speaker as shown in FIG. 4 are listed in the following table and differ greatly.

| | Bass | Middle-range | Treble |
|---|---|---|---|
| C | 172 μF | 62.7 μF | 4.3 μF |
| L | 34.8 mH | 7 mH | 2.1 mH |
| R | 40Ω | 13.2Ω | 3.1Ω |
| $R_s$ (moving coil) | 6.8Ω | 7.2Ω | 4.9Ω |
| $L_s$ (moving coil) | 1.1 mH | 0.35 mH | 0.07 mH |

-continued

| | Bass | Middle-range | Treble |
|---|---|---|---|
| Resonant frequency | 65 Hz | 240 Hz | 1650 Hz |

A different bass loud-speaker with a resonant frequency of 37 Hz may, however, have values throughout of C=300 μF, L=60 mH and R=50Ω. Discrete components in this magnitude range that can be matched to different loud-speakers can only be made with disproportionately large, and uneconomical, expenditure.

It has been attempted to obtain an improved correction signal using an equivalent circuit for the actual loud-speaker. The equivalent circuit is additionally inserted in a feedback circuit according to FIG. 5*a*. The disadvantage of this equivalent circuit is that equivalent circuits made up of discrete parts using coils, condensers and resistors, and the electrodynamic transducer itself, differ considerably in the assembled end product, even with low component and manufacturing tolerances. Such an equivalent circuit made up of discrete components is therefore not easily adapted to the actual loud-speaker conditions, cannot be tuned and is expensive. The equivalent circuit according to FIG. 4 which has been made up of discrete parts using coils, condensers and resistors can also be arranged inversely in series with the loud-speaker (FIG. 5*b*), as is known from U.S. Pat. No. 3,988,542. Furthermore, in this case the circuit is current-driven in order for it to be possible for the portions of the moving-coil impedance and the moving-coil inductance in the equivalent circuit to be neglected. This, however, still leaves the disadvantages of the large component tolerances of loud-speaker and equivalent circuit and the virtual impossibility of matching the circuit to a specific loud-speaker, which make this process unusable in practice.

Figure 5A:
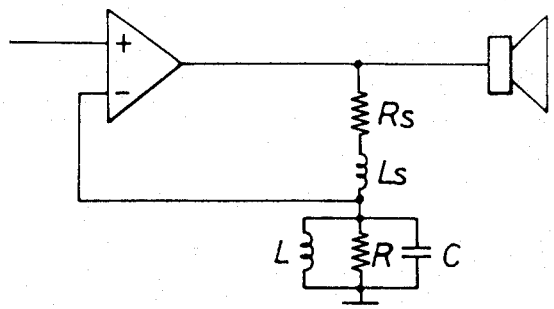
Figure 6:
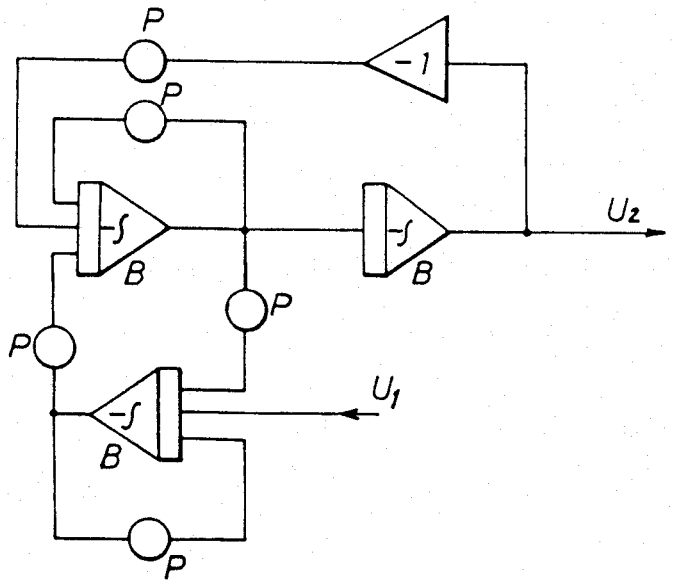

It is not possible either to obviate the disadvantages described above of the electrical equivalent circuit made up of discrete components for a loud-speaker by using its more easily tuned electrical equivalent circuit as an analogue computer circuit according to FIG. 6. Since the exact electrical simulation of a loud-speaker system in the form of an analogue computer circuit already comprises a plurality of feedbacks and a further feedback causes its inherent properties to change, it cannot be connected into a feedback branch as can a loud-speaker equivalent circuit made up of discrete components as shown in FIG. 5*a*. The circuit also becomes unstable as a result and starts to oscillate.

Figure 5B:
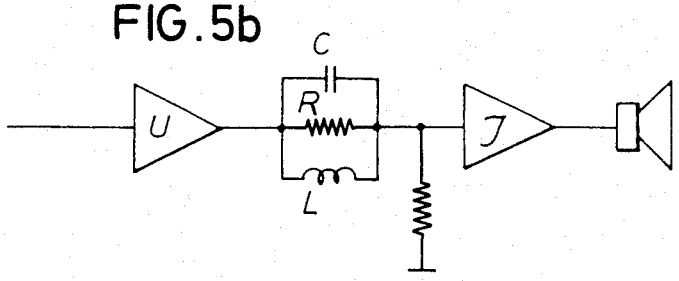

It is not possible either to operate the analogue computer circuit for the loud-speaker in the same manner in FIG. 5*b* inversely in series with the loud-speaker, as this circuit, like all electronic circuits having operational amplifiers, operates in one direction only and it is not possible to exchange the inputs and outputs in order to reverse the effect. It is also already known from U.S. Pat. No. 4,340,778 to compensate individually by means of a circuit for the influence of the moving coil, the acoustic efficiency, the mechanical suspension, the damping and the like. In this case, a plurality of compensation circuits are arranged one after the other. However, since all the influences of the electrodynamic oscillatory system of the loud-speaker are dependent on one another and, in addition, influence one another in turn, such compensation circuits cannot effectively prevent the errors, but rather create new, different errors which likewise manifest themselves as distortion or sound colouration.

The problem on which the invention is based is to indicate a device for compensating reproduction errors in an electroacoustic transducer, especially a transducer that operates according to the electrodynamic principle, by means of which device the signals occurring in the electrical section of the transmission path are changed in such a manner that the errors caused by the system are compensated at least to a great extent. The compensation devices are intended to comprise economical electronic components and adjusting members and to be easily and individually adjustable within wide ranges to different types of transducer.

Because the different samples of loud-speaker of the same type exhibit great electrical differences even where the component and manufacturing tolerances are small, the easy individual adjustability to the individual sample is of considerable advantage.

The advantages of the compensation circuit become even clearer when account is taken of the fact that the easy adjustability is just as possible not only in small partial ranges, but even for types of loud-speakers that differ as greatly as do bass, middle-range and treble speakers. Compared with the expenditure on the manufacture of equivalent circuits that are made up of discrete parts, that is to say using condensers, coils and resistors, and have large component values, there is great advantage to be gained in terms of cost from the expenditure on the material for the electronic components and from the adjustability of the final control elements.

Because the compensation circuit can be used universally, that is to say, for all electrodynamic loud-speaker systems, electrodynamic headphones, electrodynamic microphones and electrodynamic pickup systems, it has a large field of use and still more advantages in terms of cost and manufacture resulting from mass or series production.

If, when the compensation circuit is used in all the branches of a multipath speaker box, the divider network is designed according to German Patent DE No. 33 04 402 C1 and hence ensures the correct building-up processes and also the same phase position for all the frequency ranges, no further phase shifts or sound changes are produced (by superimposition of several frequency ranges which have had different phase shifts) over the entire multipath speaker box in the building-up response of the bass, middle-range and treble loud-speakers in case of bursts of sound from sound mixtures, as are often encountered in music, for example when a piano, guitar or drum is played. The diaphragms of the treble, middle-range and bass loud-speakers remain in the same phase in the case of all excitations caused by impulses or by notes of long duration. As a result, the problem of the transition frequency between bass and middle-range notes or middle-range and treble notes is solved for the first time, in a manner that is feasible in practice and favourable from the point of view of cost. For the reasons given, it has in practice only been possible to reach a compromise hitherto, the individual diaphragms being able to move in phase either for built-up sounds or for impulses and to generate acoustically correct superimpositions.

Also advantageous is the fact that commercially available models of loud-speakers can be used in the construction of the loud-speaker. No special products are required, such as, for example those having sensors for readjustment or expensive close-tolerance components and special manufacturing processes to keep to specific inherent values.

A further advantage is the fact that the electrical inherent properties of the compensation circuit do not change as a result of the circuit being loaded during operation, which happens with coils and condensers as a result of heating during operation. It is also advantageous that non-linearities caused by components, such as, for example, in the case of the coil, by hysteresis, saturation and eddy current, do not occur in the adjustable compensation circuit having operating amplifiers.

The easy and universal adjustability of the circuit is also of advantage if a transducer is destroyed and has to be replaced. In such a case the compensation circuit is of great value when repairs have to be made.

The ability of the circuit to be adapted to loud-speaker developments of the future, such as, for example, to new loud-speakers having a magnetic liquid in the air gap of the magnet or loud-speakers having new flat diaphragms, also increases its value.

A further considerable advantage of the compensation circuit which should be mentioned is the fact that it can be produced extremely cheaply as a result of having only a few active components.

There should also be mentioned the small space requirement of the compensation circuit which can easily be related to the size of one of the operation amplifiers that are customary at present, as compared with the large discrete components of a loud-speaker equivalent circuit, for example when used in the bass range.

The invention is described in detail below with the aid of diagrammatic drawings, formulae and a concrete embodiment for a bass loud-speaker. The following list includes FIGS. 1 to 6, which have already been discussed.

Figure 2:
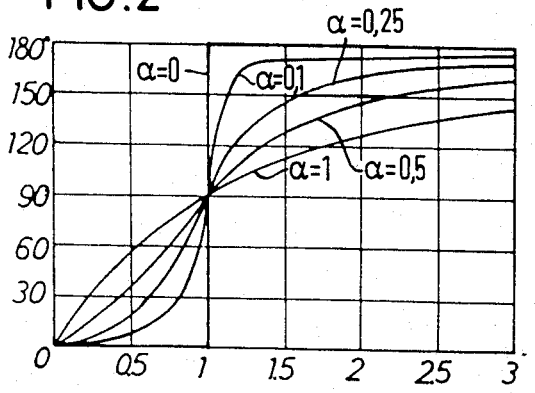
Figure 7:
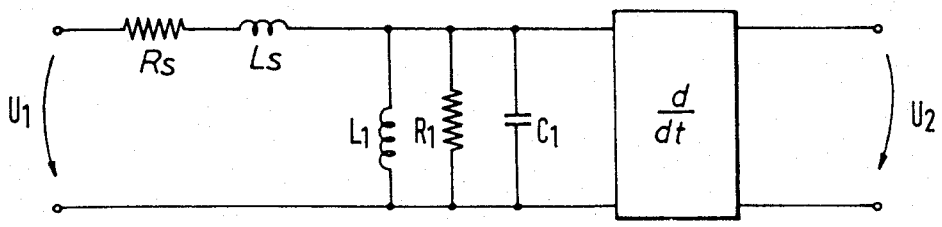
Figure 8A:
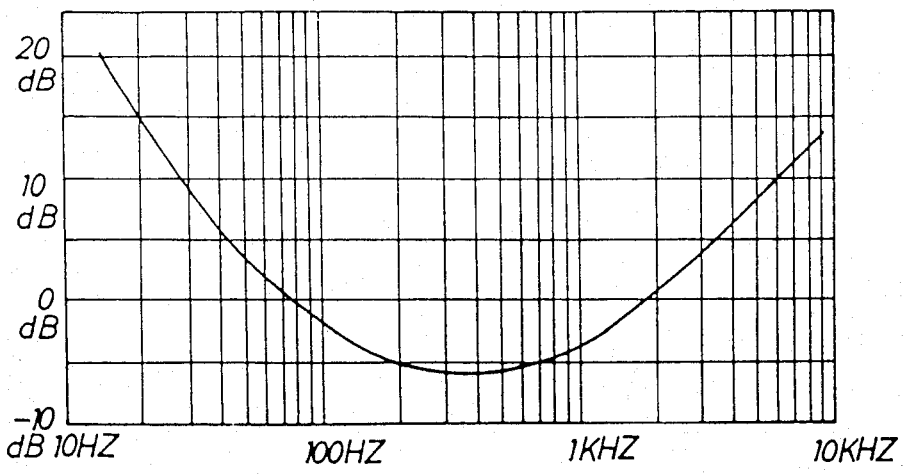
Figure 8B:
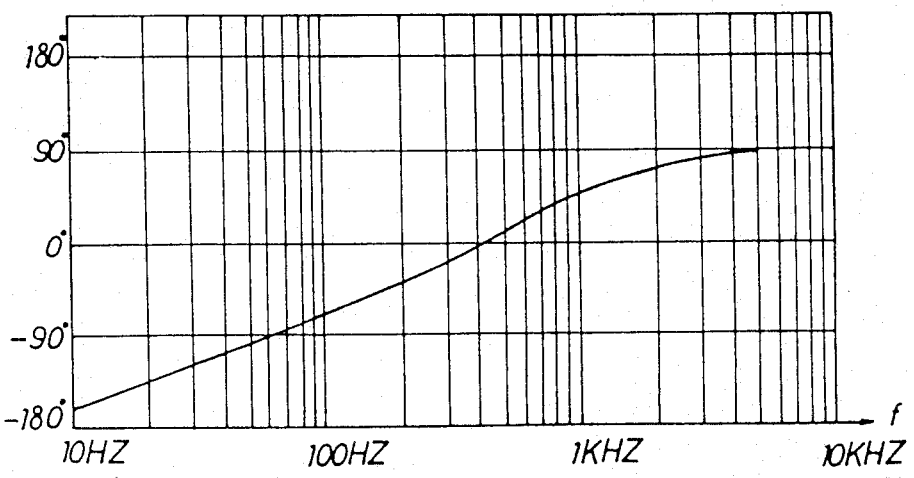
Figure 9A:
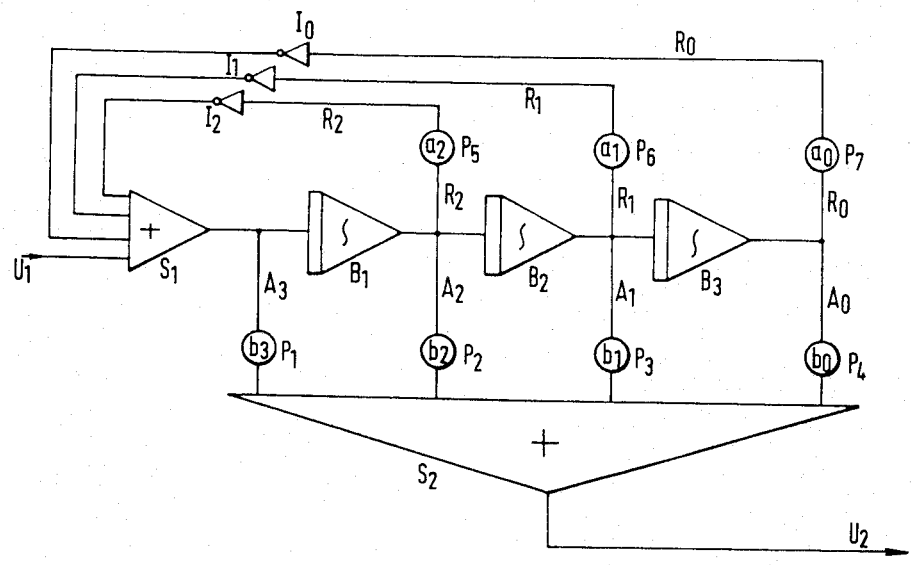
Figure 9B:
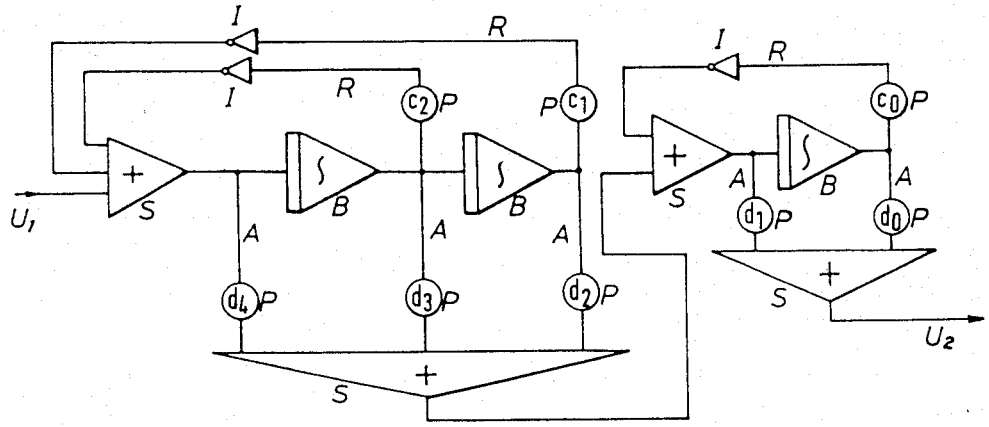
Figure 9C:
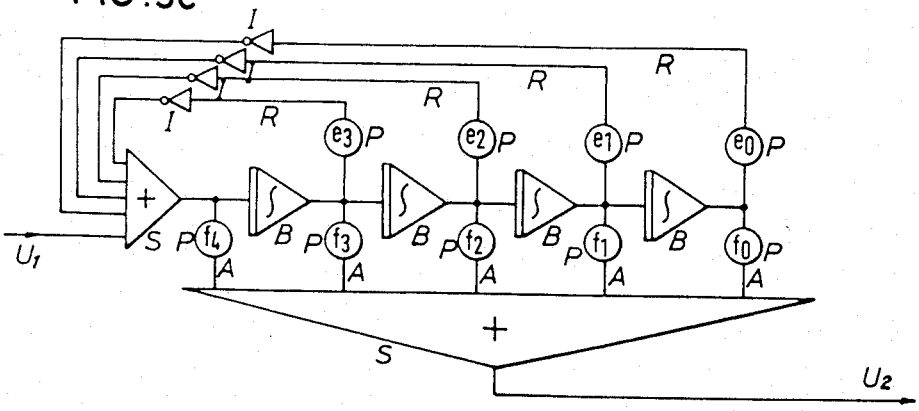
Figure 9D:
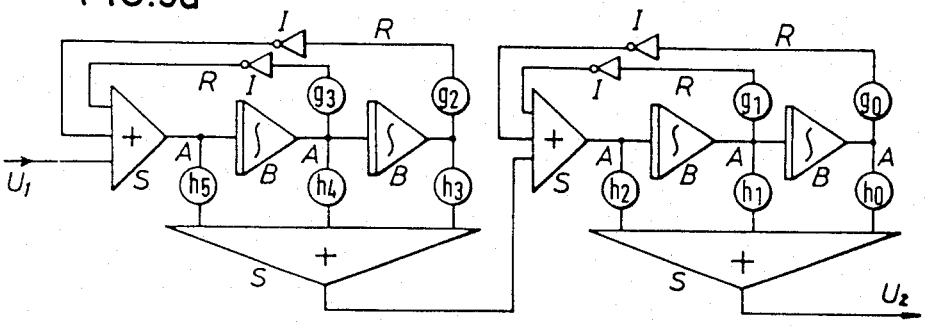
Figure 9E:
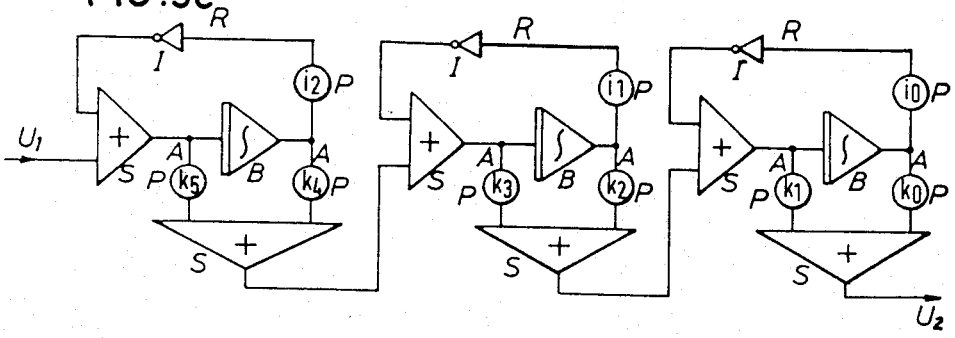
Figure 10A:
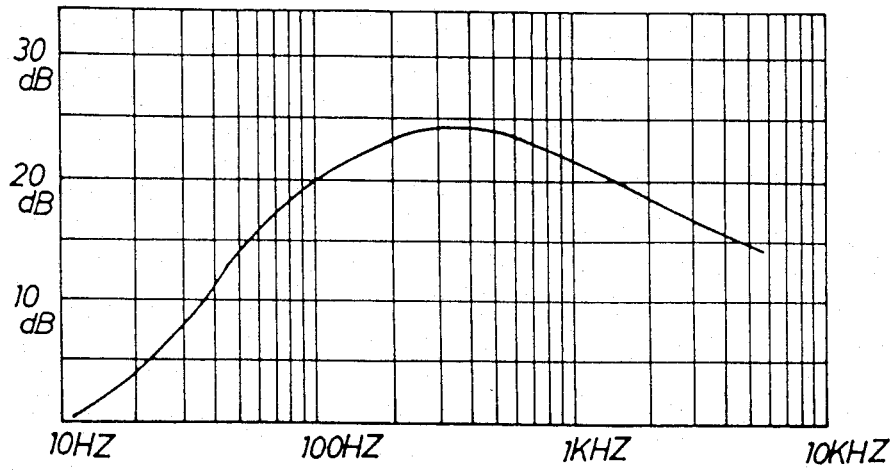
Figure 10B:
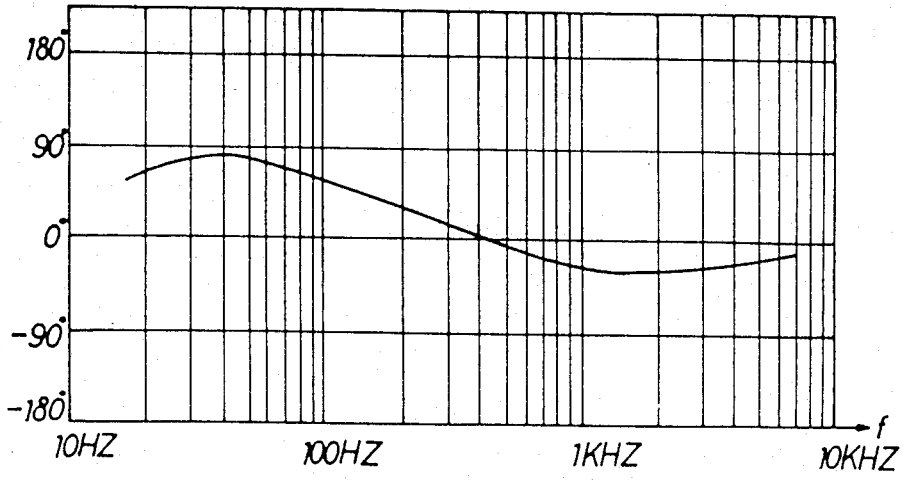
Figure 11A:
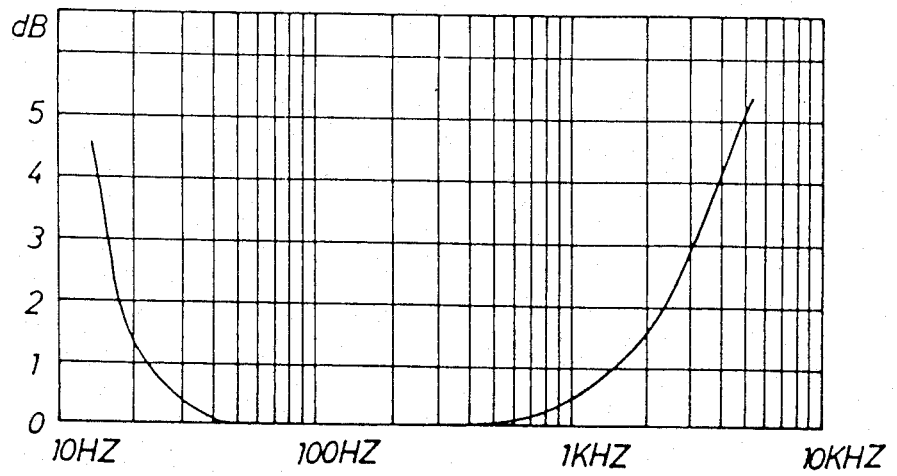
Figure 11B:
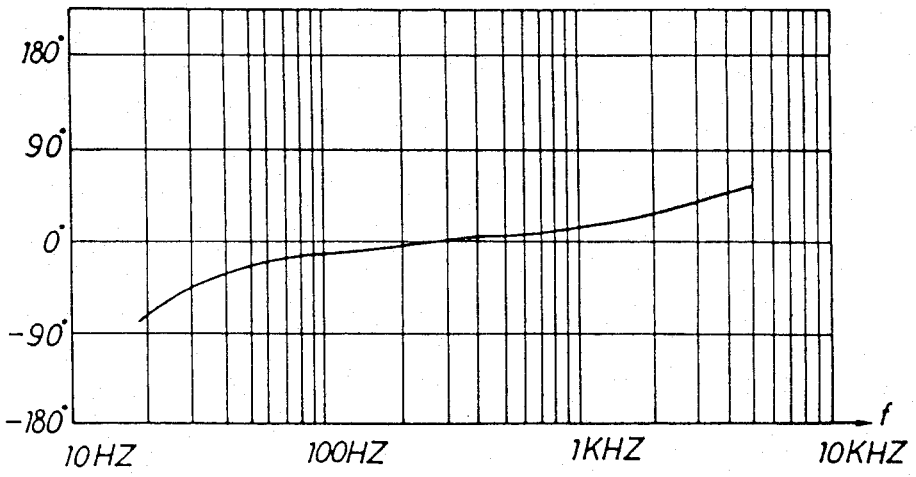
Figure 12:
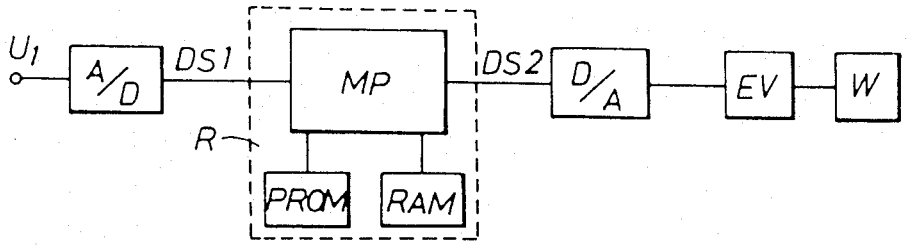
Figure 13:
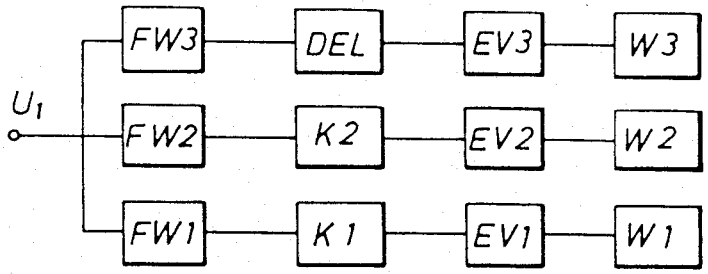
Figure 14:
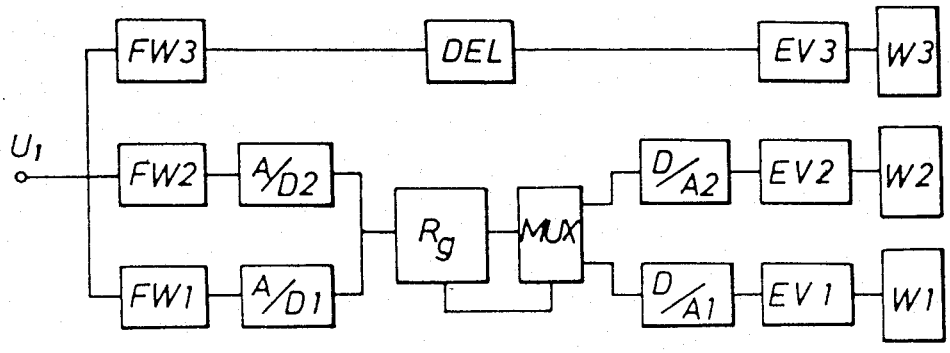

FIG. 1 shows the amplitude/resonance response of known electrodynamic transducers for various damping factors $\alpha$, FIG. 2 shows the phase/resonance response of known electrodynamic transducers for various damping factors $\alpha$, FIG. 3 shows the scheme of known diaphragm feedback in the case of loud-speakers, FIG. 4 shows an electrical equivalent circuit made up of discrete components for a known electrodynamic loud-speaker, FIG. 5*a* shows the scheme of a feedback by way of a known electrical equivalent circuit made up of discrete components and simulating the electrodynamic loud-speaker, FIG. 5*b* shows a circuit that is electrically equivalent to the circuit according to FIG. 5*a* and has a known electrical loud-speaker equivalent circuit for the electrodynamic loud-speaker which is connected inversely and in series, and is made up of discrete components, FIG. 6 shows a known electrical equivalent circuit for an electrodynamic loud-speaker constructed as an analogue computer circuit, FIG. 7 shows a known electrical loud-speaker equivalent circuit for the electrodynamic loud-speaker, which circuit is made up of discrete components, and an attached differentiating stage, FIG. 8*a* shows the damping curve which is given by the loud-speaker or its equivalent circuit according to FIG. 7 for the example of an electrodynamic bass loud-speaker, FIG. 8*b* shows the phase-angle curve which is given by the loud-speaker or its equivalent circuit according to FIG. 7 for the example of an electrodynamic bass loud-speaker, FIG. 9*a* shows the basic construction of a compensation circuit according to the invention having 3 integrators, FIG. 9*b* shows a modified embodiment of a compensation circuit according to the invention as shown in FIG. 9*a*, FIG. 9*c* shows a modified embodiment of a compensation circuit according to the invention having 4 integrators, FIG. 9*d* shows a modified embodiment of a compensation circuit according to the invention as shown in FIG. 9*c*, FIG. 9*e* shows a modified embodiment of a compensation circuit according to the invention as shown in FIG. 9*a*, FIG. 10*a* shows the corresponding curve of the damping function of the compensation circuit for the calculated example of the electrodynamic bass loud-speaker, FIG. 10*b* shows the corresponding curve of the phase angle of the compensation circuit for the calculated example of the electrodynamic bass loud-speaker, FIG. 11*a* shows the curve of the damping error compared with the ideal transfer function on a graph, FIG. 11*b* shows the curve of the phase errors compared with the ideal phase curve, FIG. 12 shows a circuit diagram of the device according to the invention using a digital computer circuit, FIG. 13 shows a device in which the total frequency range of the input signal is divided into three partial frequency ranges, and FIG. 14 shows a variation of the device according to FIG. 13.

FIG. 7 shows a known loud-speaker equivalent circuit diagram with a downstream differentiating stage. The values for the example with the bass loud-speaker are determined dynamically from the bass, that is to say, the complex input impedance is measured for different frequencies and the component values for the known equivalent circuit are calculated mathematically therefrom. The response of the equivalent circuit corresponds exactly to that of the loud-speaker itself.

| | |
|---|---|
| $R_S = 6.8\Omega$ | $R_1 = 40\Omega$ |
| $L_S = 1.1$ mH | $L_1 = 34.8$ mH |
| | $C_1 = 172\ \mu F$ |

The voltage $U_1$ is applied to the input terminals of the loud-speaker or its exact electrical simulation by the equivalent circuit and the voltage $U_2$ can be taken off at the output terminals.

From the relationship $U_1/U_2$ is obtained the damping function and from the phase displacement of $U_1$ with respect to $U_2$ is obtained the phase-angle curve. The general mathematical damping function for the above example is as follows:

$$H_1(p) = \frac{U_1}{U_2} = L_S C_1 \cdot \frac{p^3 + \left(\frac{R_S}{L_S} + \frac{1}{R_1 C_1}\right) p^2 + \left(\frac{R_S}{R_1 C_1 L_S} + \frac{1}{L_1 C_1} + \frac{1}{L_S C_1}\right) p + \frac{R_S}{L_1 L_S C_1}}{\tau p^2} \quad \text{(Equation 1)}$$

In order to simplify the calculation, the component values are standardised. The reference values (Index B), which are in themselves freely selectable, are selected to produce the simplest possible relationships.

| Reference values (Index B) | Standardisation (Index n) |
|---|---|
| $f_B = 65.05284$ Hz freely sel. | $R_{sn} = R_S/R_B = 0.4780$ |
| $L_B = 34.80$ mH freely sel. | $L_{sn} = L_S/L_B = 0.031609$ |
| $C_B = 172\ \mu F$ freely sel. | $L_{ln} = L_l/L_B = 1$ |
| $R_B = L_B.2\pi.f_B = 14.224$ | $C_{ln} = C_l/C_B = 1$ |
| $T_B = 1/(2\pi f_B)$ Reference time | $R_{1n} = R_l/R_B = 2.8121$ |
| $\tau$ = Time constant of the differentiating element | $\tau_n = \tau/T_B = 1$ (selected) |

The standardised values are used in Equation (1) and give the dimensionless coefficients of Equation (2).

$$H_1(p) = C_o \cdot \frac{p^3 + v_2 p^2 + v_1 p + v_o}{\tau_n p^2} \quad \text{(Equation 2)}$$

$$C_o = L_{sn} C_{1n} = 0.031609$$

$$v_2 = (R_{sn}/L_{sn} + 1/(R_{1n} \cdot C_{1n})) = 15.47977$$

$$v_1 = (R_{sn}/(R_{1n} \cdot C_{1n} \cdot L_{sn}) + 1/(L_{1n} \cdot C_{1n}) + 1/(L_{sn} \cdot C_{1n})) = 38.014808$$

$$v_o = R_{sn}/(L_{1n} \cdot L_{sn} \cdot C_{1n}) = 15.124173$$

or again, presented differently, $$H_1(p) = C_o \cdot \frac{(p + q_1) \cdot (p + q_2) \cdot (p + q_3)}{\tau_n p^2} \quad \text{(Equation 3)}$$

gives the coefficients:

$q_1 = 0.494082$
$q_2 = 2.439917$
$q_3 = 12.54577$
$\tau_n = \tau/T_B$
$C_o = 0.031609$ This damping function which is to be compensated by the compensation circuit as a function of the frequency is given in FIG. 8*a* for the example of the bass loud-speaker, but the curve is basically the same for all electrodynamic transducers. Likewise, the phase-angle curve to be compensated by the compensation circuit as a function of the frequency is shown in FIG. 8*b* for the example of the bass loud-speaker, but this curve is also the same diagrammatically for all electrodynamic transducers (see also FIG. 2). Simply reversing Equation (3) in order to obtain the entire loud-speaker response in inverse form does not produce a solution, as this function is not stable from the point of view of circuit technology and oscillates within itself.

Shown below is the development of a compensation circuit which, like the equivalent circuit of the loud-speaker in the form of an analogue computer, has similar complex cross-connections, but represents an adequate approximation to the inverse function only in the transmission range of the loud-speaker.

Outside the transmission range, for example for a bass loud-speaker in the middle sound range or for a middle-range loud-speaker in the bass and treble ranges or for a treble loud-speaker in the bass and middle ranges, a determinable error that is as small as desired is obtainable by adjustment of the circuit. However, since the loud-speaker is operated by way of a divider network, which strongly damps the range of frequencies outside the transmission range, this obtained error never appears at all in practice. It is therefore advantageous for the compensation circuit to be located downstream of the divider network and upstream of the loud-speaker.

In the process according to the invention, the inverse function H(p) in the general form of the polynomial is applied in such a manner that the numerator from Equation (3), together with the coefficients determined from the loud-speaker, comes into the denominator of Equation (4) and the new numerator is applied generally in Equation (4). The mathematical stability criterion requires that the order of the numerator of the polynomial be the same as or greater than the order of the denominator.

$$H(p) = \frac{U_1}{U_2} = C \cdot \frac{\left(p^2 + \frac{\omega_o}{Q} p + \omega_o^2\right) \cdot (p + q)}{(p + q_1)(p + q_2)(p + q_3)} \quad \text{(Equation 4)}$$

A general statement in which the coefficients of the denominator are also calculated or a different statement with the numerator of the fourth order or even higher, would also be possible. If, however, all the coefficients, for example of the denominator and the numerator, are freely selectable, the calculation effort involved in achieving a good approximation solution is greater. If the order of the denominator is set higher than necessary, on the one hand more calculation effort is required and, on the other, corresponding to the magnitude of the order, a large number of integration stages is required in the circuit, which, as it becomes more complicated, may again exhibit errors in signal processing. In practice, as a result of the weakening of the signal, the last integration stages have only a slight influence on the compensation curve in response to the adjustment of the potentiometer. A circuit of the fourth, fifth and higher orders, having 4, 5 or more integration stages, is therefore no better than a precisely tuned compensation circuit having 3 integration stages.

It is of value to determine from several aspects and to the desired degree of accuracy the coefficients for Equation (4) or a different equation of a higher order by an iterative solution process. These aspects are:

1. The adjustment and correction of the freely selectable coefficients that are to be determined must always be carried out over the entire system, as it is only in this manner that the complex reactions caused by the adjustment of one coefficient on the others can be accommodated.
2. The approximation of the transfer function to the inverse damping function according to Equation (3) is effected only in the selected transmission range.
   Such a curve is shown in FIG. 10*a* for the example of the bass loud-speaker.
3. The form of the approximation of the transfer function in the selected transmission range to the inverse damping function according to Equation (3) should preferably be effected in monotonic form. If the approximated curve form of the damping curve does not approximate monotonically to the given curve form, but, for example, swings around the given curve form with positive and negative deviations, there is not good agreement in the approximation of the phase-angle curve. The monotonic approximation of the damping function can be well assessed in the representation of the damping error compared with the ideal transfer function according to FIG. 11*a*.
4. The form of the approximation of the obtained phase-angle curve in the selected transmission range to the inverse phase-angle curve should be optimum.
   Such a curve is shown in FIG. 10*b* for the example of the bass loud-speaker.
5. An error estimate of the approximation to the damping function according to FIG. 11*a* and of the phase-angle curve according to FIG. 11*b* should be effected in the desired transmission range, at the edge of the desired transmission range, and outside the desired transmission range.

The approximation process itself is effected by means of the suitable selection of coefficients which are adjusted until the desired result is achieved. The coefficient adjustment is always effected stepwise and over the whole system. The individual calculation steps can be effected numerically, with the aid of calculators or with graphic computers.

In this case the coefficient change can be assessed directly from its effect on the curve change and as a result the process can be speeded up.

In the case of coefficients that are already known approximately, for example in the case of loud-speakers of the same serial type, the fine adjustment can be carried out using an oscilloscope by means of the correct adjustment of the phase-angle curve. For this purpose the compensation circuit is connected in series with the electrodynamic loud-speaker system and the whole transmission system comprising the compensation circuit and the electrodynamic transducer or its exact equivalent circuit is driven by rectangular signals of various frequencies. The variation of the coefficients corresponds to the adjustment of the adjustable potentiometer of the compensation circuit. The aim of the optimisation is reproduction of the rectangular signal waveform, and hence of the building-up process and the decay, that is as free as possible from error and can be taken from the transducer or its equivalent circuit. This can be effected very well optically on an oscilloscope in comparison with the input signal.

In the example of the bass loud-speaker described hitherto, there were found, according to Equation (4) and the values for $q_1 = 0.494082$
$q_2 = 2.439917$
$q_3 = 12.54577$, after a plurality of approximation calculation steps, the following coefficients $C = 4.839$
$W_o = 0.25$
$Q = 0.707$
$q = 50$, or, for the converted Equation 5*a*, $$H(p) = \frac{U_1}{U_2} = \frac{p^3 + a_2p^2 + a_1p + a_o}{b_3p^3 + b_2p^2 + b_1p + b_o} \quad \text{(Equation 5a)}$$

the coefficients

| | |
|---|---|
| $a_2 = 50.353$ | $b_3 = 0.2066$ |
| $a_1 = 17.740$ | $b_2 = 3.198$ |
| $a_0 = 3.15$ | $b_1 = 7.854$ |
| | $b_0 = 3.125$ |

Reference frequency $f_B = 65.05284$ Hz

These are the coefficients which, in the circuit arrangement according to the invention shown in FIG. 9*a*, need only be carried out in the form of adjustments to the potentiometers $P_1$ to $P_7$. Any fine adjustment to the electrodynamic loud-speaker system necessary as a result of the circuit components is effected, as described above, with the aid of an oscilloscope.

The exact manner in which the compensation circuit is able to compensate the available loud-speaker inherent values can be seen from the example of the bass loud-speaker in the error curves in FIG. 11*a* and FIG. 11*b*.

The error over the range of the sound pressure transmission curve is less than 0.1 dB from 40 to 50 Hz. The error in the phase-angle curve in the range of from 80 to 800 Hz is smaller than ±10°.

The circuit arrangement according to the invention as shown in FIG. 9*a* is described in more detail below.

The circuit arrangement according to the invention shown in FIG. 9*a* has, corresponding to the degree of the differentials, according to Equation (5*a*), three positive integrators $B_1$, $B_2$ and $B_3$, connected in series. At the input the input signal $U_1$ is introduced into a summing element $S_1$. Also introduced into this summing element $S_1$ are the return lines $R_0$, $R_1$ and $R_2$ from the circuit which have in their return-line branch the adjustable potentiometers $P_7$, $P_6$ and $P_5$. The fed-back signals are in each case taken off at the outputs of the integrators $B_1$, $B_2$ and $B_3$ and inverted with the aid of the inverters $I_0$, $I_1$ and $I_2$. From the series-connected circuit comprising the input summing element and the three integrators come the four pick-ups $A_0$, $A_1$, $A_2$ and $A_3$, which have in their branches the adjustable potentiometers $P_4$, $P_3$, $P_2$ and $P_1$ and are introduced into the summing element $S_2$. At the output of the summing element $S_2$ the output voltage $U_2$ can be taken. Integrators are available in the form of integrated circuit units (for example, TL 071 CP or TL 074, made by Texas Instruments).

The circuit arrangements according to the invention shown in FIGS. 9*b*, 9*c*, 9*d* and 9*e* are modified embodiments of the circuit arrangement according to the invention shown in FIG. 9*a*, which can be derived analogously from the circuit arrangement according to the invention shown in FIG. 9*a* and the mathematical statement. S represents summing elements, B integrators, R return lines, A pick-ups, P potentiometers that can be adjusted to coefficient values and I represents inverters.

In the modified circuit arrangement according to the invention shown in FIG. 9*b*, not three but only two integrators follow one another. A third integrator is connected separately.

The mathematical statement for this is:

$$H(p) = \frac{p^2 + c_2p + c_1}{d_4p^2 + d_3p + d_2} \cdot \frac{p + c_o}{d_1p + d_o} \quad \text{(Equation 5b)}$$

The modified circuit arrangement according to the invention shown in FIG. 9*c* was produced from the mathematical statement of solution of an equation of fourth order with four integrators arranged one behind the other.

The mathematical statement for this is:

$$H(p) = \frac{p^4 + e_3p^3 + e_2p^2 + e_1p + e_o}{f_4p^4 + f_3p^3 + f_2p^2 + f_1p + f_o} \quad \text{(Equation 5c)}$$

As opposed to the circuit arrangement according to the invention shown in FIG. 9*c*, the modified circuit arrangement according to the invention shown in FIG. 9*d* was made not with four integrators in series, but with in each case two by two arranged one behind the other.

The mathematical statement for this is:

$$H(p) = \frac{p^2 + g_3p + g_2}{h_5p^2 + h_4p + h_3} \cdot \frac{p^2 + g_1p + g_o}{h_2p^2 + h_1p + h_o} \quad \text{(Equation 5d)}$$

The modified circuit arrangement according to FIG. 9*e* shows that an arrangement is also possible in which the integrators are not connected in series one directly behind the other as in FIG. 9*a*, but in which each individual integrator is shown in a circuit closed by means of feedback couplings and pick-ups, and these circuit arrangements are then simply connected in series to one another.

The mathematical statement for this is:

$$H(p) = \frac{p + i_2}{k_5p + k_4} \cdot \frac{P + i_1}{k_3p + k_2} \cdot \frac{p + i_o}{k_1p + k_o} \quad \text{(Equation 5e)}$$

In the known circuit according to FIG. 7, the signal taken from the known equivalent circuit of the electrodynamic transducer according to FIG. 4 is differentiated once. As a result there is obtained the transfer function for the damping or the acceleration. The process and the circuit arrangement for compensating the error response of electrodynamic transducers has already been described comprehensively with the aid of this acceleration-proportional and/or damping-proportional transfer function.

The pre-distorted acceleration-proportional and damping-proportional signal is suitable for being transmitted directly to the final amplifier for the electrodynamic transducer in order to compensate the inherent response of the transducer. It is also possible, however, to take the signal from FIG. 4 directly without providing a differentiating stage as in FIG. 7. There is obtained in this manner the speed-proportional transfer function of the electrodynamic equivalent circuit or of the transducer.

In this case also a similar mathematical statement and an iterative solution of the inverse speed-proportional transfer function using the same compensation circuit arrangement is possible. It is only that different coefficients are obtained. In order to be able to pass on this pre-distorted speed-proportional signal to the final amplifier for the electrodynamic transducer, it must, howproduces a delay which has to be taken into account in addition to the time required simply for the calculation.

According to FIG. 12, the series of secondary digital signals DS2 is converted into an analogue control signal $U_2$ by means of a digital/analogue converter D/A connected to the data output of the microcomputer R, and the signal $U_2$ is used to control the electroacoustic transducer W. In general, however, a power amplifier EV is connected upstream of the electroacoustic transducer W, which amplifier initially amplifies the analogue control signal $U_2$ further. Since the characteristic data of the power amplifier EV, especially its frequency response and internal resistance, are involved in the transmission chain from the original input signal $U_1$ to the acoustic vibration, these parameters must—as already mentioned—also be taken into account, together with the characteristic values of the transducer, in the calculation of the secondary digital signals DS2.

In recent years, the digital recording of music has become increasingly important. Devices for reading such recordings are capable of transmitting directly a series of digital signals corresponding to the recorded information. In such cases there is, of course, no need to provide an analogue/digital converter.

If electroacoustic transducers, for example loudspeakers, are preferably used for reproducing music, the entire frequency range of the input signal is, as a rule, divided into, for example, three partial frequency ranges. A loud-speaker designed specially for the purpose is provided for each partial frequency range. The division of the frequency range is effected by divider networks which may be designed as LC-elements, as filters having operational amplifiers or as digital filters. The latter is advantageous especially in conjunction with a digital recording.

It is often unnecessary to correct the input signal in the highest partial frequency range, the treble range. This case is shown in FIG. 13. The original input signal $U_1$ is divided by divider networks FW1 to FW3, the divider network FW1 being permeable to the lowest, and the divider network FW3 to the highest, partial frequency range.

In order to compensate the signal transit time caused by the correction units K1 and K2 comprising the analogue/digital converter, the computer and the digital/analogue converter, a delay line DEL is provided in the highest partial frequency range. The electroacoustic transducer and the upstream power amplifier are designated W1 to W3 and EV1 to EV3, respectively.

Instead of a passive delay line, it is also possible to provide a clock-controlled shift-register arrangement which, however, has to be connected upstream of an analogue/digital converter and downstream of a digital-/analogue converter. The analogue/digital converter in conjunction with a digital recording can, however, be omitted. Furthermore, the shift-register arrangement can be replaced by a further microcomputer, the only task of which is then to delay the signal.

By means of a time delay of the scanning clocks in the analogue/digital converters A/D1 and A/D2 for the bass and middle range, respectively, preferably by half a clock period, it is possible to supply the primary digital signals DS11 and DS12 of the two partial frequency ranges to the data inputs of a common microcomputer $R_g$ alternately, and hence to process them alternately, as shown in FIG. 14. A prerequisite for this is a sufficiently high processing speed for the microcomputer $R_g$ and, of course, suitable programming.

The secondary digital signals output by the microcomputer $R_g$ must be supplied separately to the two channels associated with the bass and middle ranges, depending on which they are associated with. This is effected with the aid of a multiplexer MUX controlled by the microcomputer $R_g$. The multiplexer MUX can be omitted, however, when the subsequent digital-/analogue converters D/A1 and D/A2 are designed for a clock-controlled take-over of the digital input information and the take-over clocks, which are synchronous with the data output of the microcomputer $R_g$, are phase-displaced with respect to one another.

I claim:

1. An acoustic reproduction system comprising:

an electroacoustic transducer;

a transmission path for signals to be reproduced by said transducer including an acoustic section and an electrical section; and a device for compensating for reproduction errors within a given frequency range;

said device including a computer circuit in said electrical section to receive input signals and to emit altered output signals, said computer circuit including means to simulate the inverse form of a complex transfer function derived on the basis of amplitude and phase modification characteristics typical of the transducer and to apply said said function to the input signals to generate the output signals.

2. The system in accordance with claim 1 wherein the electroacoustic transducer serves to convert electrical signals into acoustic signals and that the computer circuit is arranged upstream of the transducer in the transmission direction.

3. The system in accordance with claim 2 wherein the computer circuit comprises a digitally operating microcomputer to which a series of primary digital signals corresponding to the input signals are supplied and which emits a series of secondary digital signals; and wherein associated with the microcomputer is a read-only memory (ROM) in which the characteristic property values for the transducer and a program for converting the primary to the secondary digital signals corresponding to the characteristic values are stored and further comprising a digital/analog transducer (D/A) for converting the series of secondary digital signals to analog output signals.

4. The system in accordance with claim 3 wherein the input signals are originally present as analog signals and comprising an analog/digital coverter (A/D) for converting the input signals present as analog signals to series of primary digital signals.

5. A system in accordance with claim 4 further comprising divider networks for dividing the frequency range of the input signals into a plurality of partial frequency ranges, wherein for each partial frequency range a final amplifier and an electroacoustic transducer are provided and wherein in the lowest partial frequency range a correction unit comprising a microcomputer and, a digital/analogue converter (D/A) are provided and in the remaining partial frequency ranges signal delay means are provided.

6. A system in accordance with claim 5 wherein the primary digital signals of the lowest and the next-highest frequency range are multiplexed to the data inputs of a common microcomputer and a further comprising multiplexer controlled by the microcomputer connecting the secondary digital signals associated with the lowest and the next-highest frequency range alternately ever, be differentiated once in order to obtain the acceleration-proportional pre-distorted voltage function.

It is also possible, however, to take the signal from FIG. 4 and, instead of differentiating it once as in FIG. 7, to integrate it once. In this manner the deflection-proportional transfer function of the electrodynamic transducer or its equivalent system is obtained. In this case also a similar mathematical statement and an iterative solution of the deflection-proportional transfer function using the same circuit arrangement is possible. Again, however, different coefficients are obtained. In order to be able to pass on the pre-distorted deflection-proportional signal to the final amplifier for the electrodynamic transducer, it must, however, be differentiated twice in order to obtain the pre-distorted acceleration-proportional voltage function.

It is also known according U.S. Pat. No. 3,988,541 to connect the inverse loud-speaker equivalent circuit in series with the loud-speaker without the influence of a moving coil, that is to say, without the resistance and the inductance of the moving coil. In this circuit arrangement, however, the loud-speaker must be current-driven otherwise the influences of the moving coil could not be neglected.

This type of equivalent circuit made up of discrete components can also be approximated by means of a compensation circuit according to the invention. Because there is no influence from the moving coil, only a second-order statement is obtained. The coefficients are dtermined according to the same iteration process. The disadvantages of this circuit arrangement derive from the fact that current amplifiers are not customary, because they are very difficult to dimension correctly and easily become unstable. A damping of the membrane movement is also not possible by the current of the amplifier in case of an amplifier having a high internal resistance, however, in case of an amplifier having a low internal resistance.

The measures for compensating system-induced reproduction errors that have been described with reference to a bass loud-speaker can in principle be used unchanged also in connection with economical electrodynamic microphones or electrodynamical pickup systems, as the latter have the same oscillation response as do loud-speakers. The only natural difference between the two is that the change in the electrical signals in the sense of the signal flow in loud-speakers takes place before the loud-speakers and therefore represents a pre-distortion, whereas a signal change in the case of microphones or pickup systems takes place after the microphones and pickup systems and is therefore a correction of the distortion.

Instead of designing the computer circuit for compensating reproduction errors as a pure analogue circuit, it is also possible to use a digital computer circuit. This possibility, which is especially advantageously used when the electrical signals are already present in the form of digital signals during the conversion of electrical signals to acoustic signals, is described below.

FIG. 12 shows the circuit diagram of a corresponding device which serves to produce a pre-distorted control signal for the electroacoustic transducer derived from the original input signal. The pre-distortion must be dependent on the instantaneous shape of the input signal and must be so dimensioned that the inadequacies of the real transducer system, including the surrounding medium, are compensated as far as possible.

According to FIG. 12, the original input signal $U_1$ is converted by means of an analogue/digital converter A/D into a series of digital signals DS1. The digital signals DS1 that are output at a repetition frequency (scanning frequency), which is high compared to the highest frequency of the input signal, of, for example, 100 kHz, represent the binary coding of, in each case, one amplitude value that is different from, for example, 128. Each datum, comprising, for example, 7 bits, thus reproduces the (instantaneous) amplitude value present at the point in time that it is scanned, in the variation with time of the input signal $U_1$.

The series of digital signals DS1 is supplied to the data inputs of a microcomputer R, which comprises essentially a microprocessor MP, at least one programmable read-only memory PROM and a read/write memory RAM acting as the working memory and, together with several auxiliary devices, which will not be described in more detail, is known per se.

Stored in the read-only memory PROM are all the important characteristic values for the quality of reproduction of the electroacoustic transducer, that is to say, for example, of an electrodynamic loud-speaker having an upstream power amplifier and mounted in a housing, or of a microphone. These characteristic values relate to parameters such as slip, inertia of the sound-distributing diaphragm and the pre-stored volume of air, tensioning and restoring forces, damping, resonant frequencies and the like, and, where appropriate, the frequency response and internal resistance of the power amplifier.

With the aid of a programme stored likewise in the above-mentioned programmable read-only memory or in a second, separately addressable memory of the same type, the digital signals DS1 input into the computer, which from now on will be designated primary digital signals, are converted, according to the characteristic values of the transducer, into secondary digital signals DS2. Conversions are only meaningful, however, if, for example, level jumps by the input signal $U_1$ occur or if its instantaneous oscillation frequency comes sufficiently close to a resonant frequency of the transducer. On the other hand, conversion is omitted if the input signal $U_1$ has a waveform corresponding to a sine function, the peak values of which are subjected to only insignificant variations, if any.

In order, however, to be able to make observations regarding the waveform of the input signal $U_1$, the computer R requires at least three successive scanning values from the curve of the input signal. It can determine from these values both the steepness and the curvature of the curve. The changes in the curve of the input signal $U_1$ which are of especial interest for the present purpose can be determined by a comparison with earlier scanning values.

The manner in which the conversions are carried out, which amounts to the solution of differential equations of forced oscillation (cf. Istvan Szabo, Einführung in die technische Mechanik [Introduction to industrial mechanics] Springer-Verlag 1963, pages 348, 349) is not described in detail here.

Since each necessary correction of the secondary digital signals DS2 should be effected as early as possible, for example immediately after a detected level jump, the input of the next two digital signals must be awaited before the digital signal associated with the first of, in each case, three scanning values is converted. This through to the inputs of the corresponding digital-/analogue converter.

7. A system in accordance with claim 5 wherein the primary digital signals of the lowest and at least the next-highest frequency range are multiplexed to the data inputs of a common microcomputer, the inputs of the digital/analogue converter for the lowest and at least the next-highest frequency range are connected in parallel and are connected to the data outputs of the microcomputer and the transmission of the secondary digital signals into the digital/analogue converter can be multiplexed by signals supplied by the microcomputer.

8. A system in accordance with claim 7 wherein the construction of the computer circuit corresponds to a third-order transfer function.

9. The system in accordance with claim 1 wherein the electroacoustic transducer serves to convert acoustic signals into electrical signals and the computer circuit is arranged downstream of the transducer in the transmission direction.

10. Device according to claim 9 wherein the input signals are originally present as a series of primary digital signals.

11. A system in accordance with claim 1 wherein the computer circuit is designed as an analogue circuit comprising a plurality of integrators, adjusting members and two summing circuits, the input signals are applied to the input of the first summing circuit and other inputs are connected via inverters and adjusting means to outputs of one of said integrators connected downstream of the first summing circuit, the output of the first summing circuit and the outputs of the integrators are connected by way of further adjusting means to the inputs of the second of said summing circuits at the output of which the output signal can be taken; wherein the number of integrators contained in the computer circuit is equivalent to the order of the transfer function by means of which the complex inherent response of the transducer is approximated in inverse form in relation to the amplitude/frequency response and phase/frequency response.

12. A system in accordance with claim 11 wherein the number of integrators connected directly in series is in each case equal to the order of the factors of the transfer function, each group of integrators connected directly in series having associated therewith a first and a second summing circuit and corresponding adjusting means and inverters and that the output of the second summing circuit of a preceding group is connected to an input of the first summing circuit of a subsequent group.

13. A system in accordance with claim 12 wherein the construction of the computer circuit corresponds to a transfer function which in inverse form approximates to the damping-proportional or acceleration-proportional transfer function of the transducer.

14. A system in accordance with claim 12 wherein the transfer function is divided into any desired number and mixture of factors of the first and higher orders.

15. A system in accordance with claim 1 wherein said transducer includes a diaphragm and means for adjusting said diaphragm connected to said computer circuit.

* * * * *

UNITED STATES PATENT AND TRADEMARK OFFICE

CERTIFICATE OF CORRECTION

PATENT NO. : 4,675,835

DATED : June 23, 1987

INVENTOR(S) : Peter Pfleiderer

It is certified that error appears in the above—identified patent and that said Letters Patent is hereby corrected as shown below:

Col. 3, line 18; - "casee" should read -- case -- .

Col. 17, Claim 7, line 2 and line 5 bridging line 6 of Claim 7; delete "at least" in both instances.

Signed and Sealed this

Fifth Day of January, 1988

*Attest:*

DONALD J. QUIGG

*Attesting Officer*

*Commissioner of Patents and Trademarks*